US010414573B2

(12) United States Patent
Pinkstone

(10) Patent No.: US 10,414,573 B2
(45) Date of Patent: Sep. 17, 2019

(54) CONTAINER WITH WINDOW AND MICROWAVE INTERACTIVE MATERIAL

(71) Applicant: GRAPHIC PACKAGING INTERNATIONAL, INC., Atlanta, GA (US)

(72) Inventor: Felicia A. Pinkstone, Aston, PA (US)

(73) Assignee: GRAPHIC PACKAGING INTERNATIONAL, LLC, Atlanta, GA (US)

( * ) Notice: Subject to any disclaimer, the term of this patent is extended or adjusted under 35 U.S.C. 154(b) by 364 days.

(21) Appl. No.: 14/294,434

(22) Filed: Jun. 3, 2014

(65) Prior Publication Data

US 2014/0353307 A1 Dec. 4, 2014

Related U.S. Application Data

(60) Provisional application No. 61/956,215, filed on Jun. 3, 2013.

(51) Int. Cl.
*B65D 81/34* (2006.01)
*B65D 5/42* (2006.01)
(Continued)

(52) U.S. Cl.
CPC ..... *B65D 81/3453* (2013.01); *B65D 5/2033* (2013.01); *B65D 5/4204* (2013.01);
(Continued)

(58) Field of Classification Search
CPC .... B65D 2581/3405; B65D 2581/3472; B65D 2581/3497; B65D 2581/3498;
(Continued)

(56) References Cited

U.S. PATENT DOCUMENTS 1,048,577 A 12/1912 Pardoe
2,054,596 A 9/1936 Ford
(Continued)

FOREIGN PATENT DOCUMENTS

EP 183659 * 6/1986
GB 2 221 449 A 2/1990
(Continued)

OTHER PUBLICATIONS translation of JP3098624.*
(Continued)

*Primary Examiner* — Ibrahime A Abraham
*Assistant Examiner* — Frederick F Calvetti
(74) *Attorney, Agent, or Firm* — Wombke Bond Dickinson (US) LLP

(57) ABSTRACT

A container with a window through which food within the container may be seen. The window may include a hole in a base material of the container, and at least one substantially clear polymeric film that is mounted to a portion of the container and obstructs (e.g., covers) the hole. Microwave energy interactive material ("MEIM") may be mounted to the polymeric film for influencing the effect of microwave energy on the food within the container. Typically (e.g., optionally), the film extends beyond the hole, and the MEIM may be segregated to portions of the film that do not obstruct the hole, so that the MEIM does not interfere with the view through the window.

45 Claims, 6 Drawing Sheets

(51) Int. Cl.
*B65D 5/66* (2006.01)
*B65D 5/20* (2006.01)

(52) U.S. Cl.
CPC ..... *B65D 5/667* (2013.01); *B65D 2581/3405* (2013.01); *B65D 2581/3472* (2013.01); *B65D 2581/3497* (2013.01); *B65D 2581/3498* (2013.01)

(58) Field of Classification Search
CPC .... B65D 5/2033; B65D 5/4204; B65D 5/667; B65D 81/3453; B65D 2585/366
USPC ..... 229/110, 902, 906; 206/65 D, 25, 85, 206/363, 366
See application file for complete search history.

(56) References Cited

U.S. PATENT DOCUMENTS 2,091,126 A 8/1937 Speer
2,180,808 A 11/1939 Jacobstein et al.
2,194,220 A 3/1940 Elder
2,296,389 A 9/1942 Levkoff
2,320,665 A * 6/1943 Shearer ..... B65D 5/02 229/109
2,337,654 A * 12/1943 Goodyear ..... B65D 5/302 229/145
2,645,337 A * 7/1953 Stenger ..... B65D 5/302 206/525
2,701,090 A * 2/1955 Buttery ..... B65D 5/2028 229/108.1
2,707,586 A 5/1955 Buttery
2,749,245 A 6/1956 Leo
2,852,177 A 9/1958 Frasch
2,862,612 A 12/1958 Brown
2,877,736 A 3/1959 Simmons
2,924,371 A 2/1960 Frankenstein
3,071,882 A 1/1963 Eisman et al.
3,099,381 A 7/1963 Meyers
3,146,933 A 9/1964 Moore
3,205,603 A 9/1965 Brumley
3,391,782 A 7/1968 Kaspar
3,446,416 A 5/1969 Epstein
3,541,599 A 11/1970 Roberts et al.
3,610,512 A 10/1971 Hermalin
3,658,235 A 4/1972 Katzenmayer et al.
3,659,773 A 5/1972 Manizza
3,884,350 A * 5/1975 Johansson ..... B65D 5/103 206/420
3,899,119 A 8/1975 Roccaforte
3,958,744 A 5/1976 Herglotz
4,004,691 A 1/1977 Wihksne
4,076,168 A 2/1978 Ferri
4,260,099 A 4/1981 Mode
4,313,542 A 2/1982 Roberts et al.
4,472,896 A 9/1984 Brauner et al.
4,494,785 A 1/1985 Song
4,511,039 A 4/1985 Siemek
4,570,845 A 2/1986 Hall
4,572,423 A 2/1986 Spencer
4,585,124 A 4/1986 Pride
4,586,648 A 5/1986 Josefsson et al.
4,630,733 A 12/1986 Fear
4,684,023 A 8/1987 Cortopassi
4,760,950 A 8/1988 Levick
4,804,137 A 2/1989 Harby
4,844,330 A 7/1989 Roosa et al.
4,877,178 A 10/1989 Eisman
4,901,457 A 2/1990 Chandler
4,930,681 A 6/1990 Fultz et al.
4,940,190 A 7/1990 Groves
4,944,451 A 7/1990 Forbes, Jr.
4,955,527 A 9/1990 Blackman et al.
D314,887 S 2/1991 Tomaras
5,000,374 A 3/1991 Deiger
5,037,026 A 8/1991 Hanko
D320,743 S 10/1991 Alexander et al.
5,058,803 A 10/1991 Gulliver
5,060,852 A * 10/1991 Beckerman ..... B65D 5/4204 229/162.6
D322,759 S 12/1991 Groves
5,071,062 A 12/1991 Bradley et al.
5,110,038 A 5/1992 Pantisano et al.
RE33,979 E 6/1992 Cortopassi
5,181,649 A 1/1993 Frost
5,188,284 A 2/1993 Eisman
5,205,476 A 4/1993 Sorenson
D342,446 S 12/1993 Parker et al.
D346,552 S 5/1994 Krupa
5,358,176 A 10/1994 Rigby
5,368,225 A * 11/1994 Ritter ..... B65D 5/2033 229/110
5,375,761 A 12/1994 Sullivan et al.
5,388,758 A 2/1995 Scovell
5,391,864 A * 2/1995 Bodor ..... A21D 8/06 219/730
5,402,929 A * 4/1995 Ritter ..... B65D 5/2033 229/110
5,421,508 A 6/1995 Beales
5,431,333 A 7/1995 Lorenz
D365,272 S 12/1995 Krupa et al.
5,476,215 A 12/1995 Baroud
5,506,046 A * 4/1996 Andersen ..... C08L 1/28 229/164.1
5,522,537 A 6/1996 Barlow
5,535,940 A * 7/1996 Olds ..... B65D 5/2033 229/110
5,538,179 A 7/1996 Cai
5,553,772 A 9/1996 Jensen
5,586,716 A * 12/1996 Correll ..... B65D 5/2033 229/110
5,595,339 A * 1/1997 Correll ..... B65D 5/2033 229/109
5,632,379 A 5/1997 Frost
5,662,265 A 9/1997 Jensen
5,665,439 A * 9/1997 Andersen ..... B32B 5/02 106/400
5,669,552 A * 9/1997 Watanabe ..... B65D 5/2033 229/114
5,690,273 A 11/1997 Jensen
5,697,549 A 12/1997 Yocum
5,713,509 A * 2/1998 Correll ..... B65D 5/2033 229/109
5,718,368 A * 2/1998 Rench ..... B65D 5/667 229/109
5,735,454 A 4/1998 Jensen
5,788,145 A 8/1998 Grahahm et al.
5,826,781 A 10/1998 Jensen
5,890,648 A 4/1999 Cai
5,908,152 A 6/1999 Tullis
6,012,628 A 1/2000 Shaikh et al.
6,027,018 A 2/2000 Yocum
6,041,997 A 3/2000 Jensen
6,063,416 A 5/2000 Teasdale et al.
6,068,181 A * 5/2000 Cai ..... B65D 31/005 206/431
6,109,512 A * 8/2000 Morrison ..... B65D 5/665 229/110
6,206,277 B1 3/2001 Correll
6,213,389 B1 4/2001 Cai
6,283,364 B1 9/2001 Gray, Sr.
D458,127 S 6/2002 de Groote
D460,691 S 7/2002 Morris et al.
6,431,365 B1 * 8/2002 Money ..... B65D 5/2042 206/776
D467,499 S 12/2002 Garza et al.
6,501,059 B1 * 12/2002 Mast ..... B65D 81/3446 219/728
D473,787 S 4/2003 Jones, Jr. et al.
6,568,586 B1 5/2003 VanEsley et al.
6,571,539 B2 * 6/2003 Gendre ..... B65B 5/024 53/376.4

(56) References Cited

U.S. PATENT DOCUMENTS

| | | | | |
|---|---|---|---|---|
| 6,575,299 | B1 * | 6/2003 | Kinigakis | B65D 5/548 206/541 |
| D484,043 | S | 12/2003 | Hwang et al. | |
| 6,681,983 | B2 | 1/2004 | Bill-Moore | |
| 6,749,106 | B2 * | 6/2004 | Keefe, Jr. | B65D 5/2033 229/110 |
| 7,051,919 | B1 | 5/2006 | Walsh | |
| 7,097,038 | B2 | 8/2006 | Kinigakis | |
| 7,159,760 | B2 * | 1/2007 | Pluck | B65D 5/5253 206/748 |
| 7,232,054 | B2 | 6/2007 | Yocum | |
| 7,293,695 | B2 | 11/2007 | Stier | |
| 7,762,450 | B2 * | 7/2010 | Oliveira | B65D 5/02 229/107 |
| 8,225,985 | B2 * | 7/2012 | Oliveira | B65D 5/02 229/107 |
| 8,523,049 | B2 | 9/2013 | Fitzwater | |
| 8,627,998 | B2 * | 1/2014 | Martinez | B65D 5/002 229/110 |
| 8,820,621 | B2 | 9/2014 | Burke et al. | |
| 8,881,968 | B2 * | 11/2014 | Coleman, Jr. | B65D 5/5028 229/110 |
| 2001/0010327 | A1 * | 8/2001 | Saulas | B65D 5/02 229/109 |
| 2002/0109361 | A1 | 8/2002 | Parthenis | |
| 2002/0129581 | A1 | 9/2002 | Correll | |
| 2003/0047595 | A1 | 3/2003 | Bill-Moore | |
| 2004/0074953 | A1 | 4/2004 | Yocum | |
| 2004/0101605 | A1 | 5/2004 | Siegel | |
| 2004/0200891 | A1 | 10/2004 | Correll | |
| 2005/0011939 | A1 * | 1/2005 | Angelopoulos | B65D 5/2057 229/109 |
| 2005/0274780 | A1 * | 12/2005 | Charlton | B65D 33/04 229/164.1 |
| 2007/0102424 | A1 * | 5/2007 | Keefe | B65D 5/4204 219/725 |
| 2007/0194012 | A1 * | 8/2007 | Middleton | B65D 5/4204 219/730 |
| 2007/0199980 | A1 * | 8/2007 | Oliveira | B65D 5/02 229/107 |
| 2007/0267467 | A1 | 11/2007 | Burke et al. | |
| 2007/0267468 | A1 | 11/2007 | Burke et al. | |
| 2007/0275130 | A1 | 11/2007 | Cole et al. | |
| 2008/0081095 | A1 * | 4/2008 | Cole | B65D 65/14 426/107 |
| 2008/0276571 | A1 * | 11/2008 | Cichowski | B65D 33/01 53/467 |
| 2009/0246332 | A1 * | 10/2009 | Lai | A21B 2/00 426/243 |
| 2010/0038359 | A1 * | 2/2010 | Laubhan | B65D 5/5455 219/730 |
| 2010/0059579 | A1 * | 3/2010 | House | B65D 5/0254 229/120 |
| 2010/0072197 | A1 * | 3/2010 | Neff | B65D 5/5455 219/730 |
| 2010/0108750 | A1 * | 5/2010 | Coleman, Jr. | B65D 5/5028 229/200 |
| 2010/0178396 | A1 * | 7/2010 | Lafferty | A47J 27/088 426/243 |
| 2010/0237137 | A1 * | 9/2010 | Oliveira | B65D 5/02 229/107 |
| 2011/0233264 | A1 * | 9/2011 | Lombardi | B65D 5/20 229/103 |
| 2011/0253772 | A1 * | 10/2011 | Holch | B65D 5/0005 229/101.2 |
| 2011/0272411 | A1 * | 11/2011 | Sanders | B65D 5/48018 220/503 |
| 2012/0037692 | A1 * | 2/2012 | Fitzwater | B65D 5/4204 229/126 |
| 2012/0111931 | A1 * | 5/2012 | Kimhi | B65D 85/36 229/120 |
| 2013/0118946 | A1 * | 5/2013 | Suzuki | B65D 25/14 206/524.3 |

FOREIGN PATENT DOCUMENTS

| | | | |
|---|---|---|---|
| JP | 7-277318 | | 10/1995 |
| JP | 08-207174 | | 8/1996 |
| JP | 10-101056 | | 4/1998 |
| JP | 2004-59002 | | 2/2004 |
| JP | 3098624 | U | 3/2004 |
| JP | 2005-170517 | | 6/2005 |
| JP | 2007-522041 | | 8/2007 |
| JP | 2009-542538 | | 12/2009 |
| JP | 2012-502858 | | 2/2012 |
| JP | 2012-162311 | | 8/2012 |
| JP | 2012-165311 | | 8/2012 |
| JP | 2012-166821 | | 9/2012 |
| JP | 2013223612 | * | 10/2013 |
| KR | 10-2005-0090313 | | 9/2005 |
| WO | WO 92/19515 | | 11/1992 |
| WO | WO 02/34629 | A1 | 5/2002 |
| WO | WO 2005/077783 | A1 | 8/2005 |
| WO | WO 2008/005748 | A1 | 1/2008 |
| WO | WO 2008/137525 | A2 | 11/2008 |
| WO | WO2010033561 | * | 3/2010 |

OTHER PUBLICATIONS translation of JP 20142162311 (Year: 2018).*

International Search Report and Written Opinion for PCT/US2014/040625 dated Oct. 1, 2014.

Supplementary European Search Report for EP 14 80 7866 dated Feb. 9, 2017.

Supplementary Partial European Search Report for EP 14 80 7866 dated Dec. 1, 2016.

Notification of Reasons for Refusal for Japanese Patent Application No. 2016-518400 dated May 8, 2017, with English translation.

Office Action for Japanese Application No. 2016-518400 dated Oct. 18, 2018, with English summary of objections.

* cited by examiner

CONTAINER WITH WINDOW AND MICROWAVE INTERACTIVE MATERIAL

CROSS-REFERENCE TO RELATED APPLICATIONS

This application claims the benefit of U.S. Provisional Application No. 61/956,215, which was filed on Jun. 3, 2013.

INCORPORATION BY REFERENCE

U.S. Provisional Application No. 61/956,215, which was filed on Jun. 3, 2013, is hereby incorporated by reference for all purposes as if presented herein in its entirety.

FIELD OF DISCLOSURE

This disclosure relates to food preparation, and, more specifically, to packages that may be used to prepare foods in a microwave oven.

BACKGROUND

Microwave ovens commonly are used to cook food in a rapid and effective manner. To optimize the cooking performance of microwave ovens, various packaging configurations have been developed to block, enhance, direct, and otherwise affect microwave interaction with food.

SUMMARY

An aspect of this disclosure is the provision of a container with a window through which food within the container may be seen. The window may include a hole in a base material of the container, and at least one substantially clear polymeric film that is mounted to a portion of the container and obstructs (e.g., covers) the hole. Microwave energy interactive material ("MEIM") may be mounted to the polymeric film for influencing the effect of microwave energy on the food within the container. Typically (e.g., optionally), the film extends beyond the hole, and the MEIM may be segregated to portions of the film that do not obstruct the hole, so that the MEIM does not interfere with the view through the window.

In one example, the container is at least generally in the form of a clamshell, paperboard carton; however, the container may be in any other suitable form. In the clamshell carton example, the carton has a receptacle and a lid, and the window may extend into both the receptacle and the lid. More specifically, the receptacle may be in the form of a tray, and the tray and lid may be pivotably connected to one another by at least one hinge line. The window may extend across the hinge line(s) and into the tray and/or the lid.

Another aspect of this disclosure is the provision of a carton that may optionally include a window for viewing contents in the carton, wherein any window may be as discussed above. The carton may have a tray and a lid that may be hingedly connected to one another. The carton may include a sidewall positioned between, and connecting, the tray and the lid to one another. The sidewall may be characterized as being a portion of the tray and/or the lid, and/or the sidewall may be characterized as being part of a compound hinge assembly for pivotably connecting the tray and the lid to one another. The sidewall may be perforated for at least partially defining a hole of the window.

In one aspect, the disclosure is generally directed to a carton for heating a food product. The carton comprises a lid comprising a central lid panel and at least one lid side panel foldably connected to the central lid panel. A tray comprises a central tray panel and at least one tray side panel foldably connected to the central tray panel. A side panel is foldably connected to the central tray panel and the central lid panel, and an aperture is in at least a portion of the side panel.

In another aspect, the disclosure is generally directed to a blank for forming a carton for heating a food product. The blank comprises a lid portion for forming a lid in the carton formed from the blank. The lid portion comprises a central lid panel and at least one lid side panel foldably connected to the central lid panel. A tray portion is for forming a tray in the carton formed from the blank. The tray portion comprises a central tray panel and at least one tray side panel foldably connected to the central tray panel. A side panel is foldably connected to the central tray panel and the central lid panel, and an aperture is in at least a portion of the side panel.

In another aspect, the disclosure is generally directed to a method of forming a carton. The method comprises obtaining a blank comprising a lid portion having a central lid panel and at least one lid side panel foldably connected to the central lid panel, a tray portion having a central tray panel and at least one tray side panel foldably connected to the central tray panel, a side panel foldably connected to the central tray panel and the central lid panel, and an aperture in at least a portion of the side panel. The method comprises forming a lid of the carton by positioning the at least one lid side panel relative to the central lid panel, and forming a tray of the carton by positioning the at least one tray side panel relative to the central tray panel. The tray being foldably connected to the lid by way of the side panel.

The foregoing presents a simplified summary of some aspects of this disclosure in order to provide a basic understanding. The foregoing summary is not an extensive summary of the disclosure and is not intended to identify key or critical elements of the disclosure or to delineate the scope of the disclosure. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which are not necessarily drawn to scale. The drawings are exemplary only, and should not be construed as limiting the disclosure.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the disclosure. Other embodiments, and modifications and improvements of the described embodiments, will occur to those skilled in the art and all such other embodiments, modifications and improvements are within the scope of the present disclosure.

Figure 1:
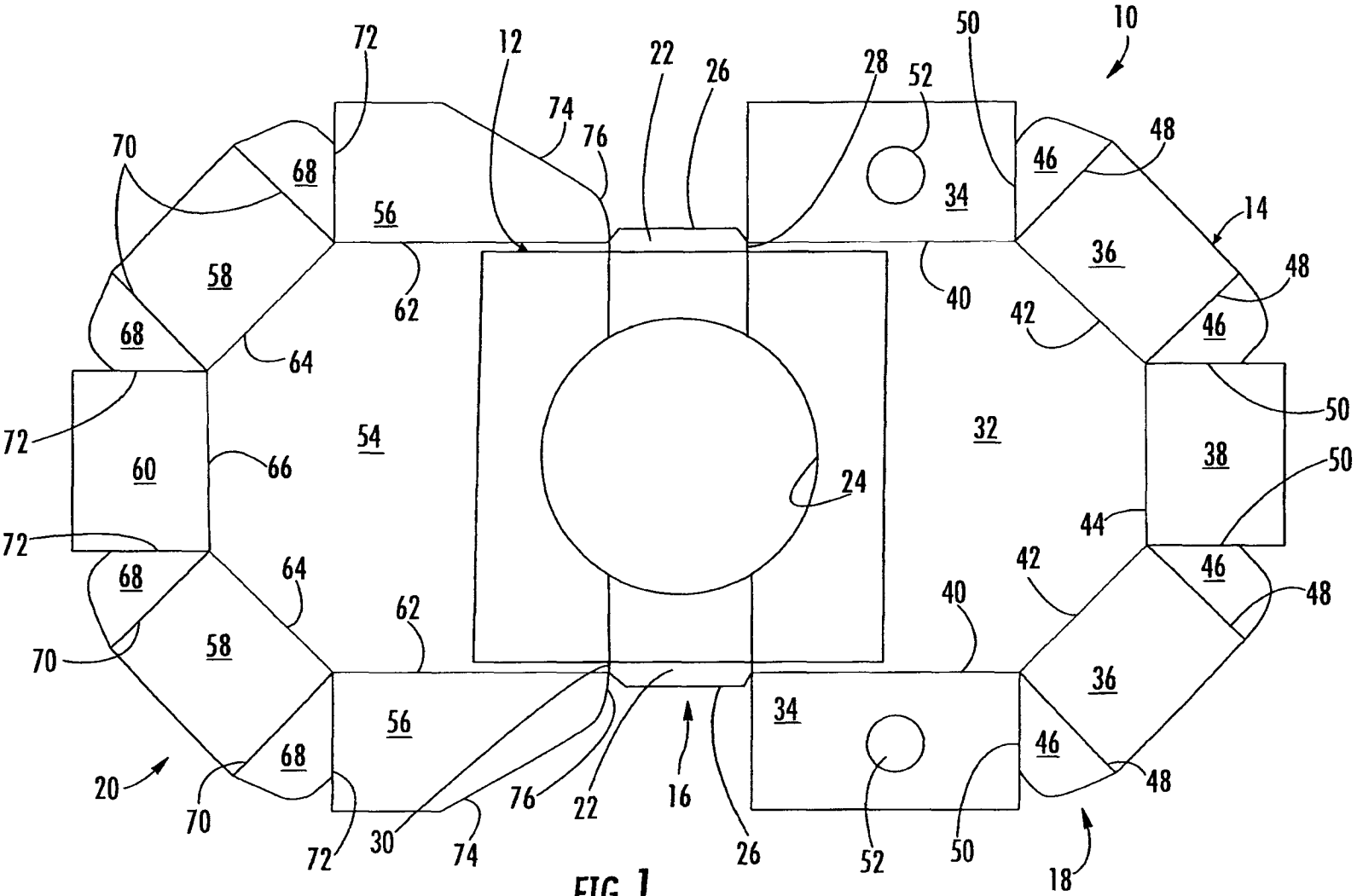
FIG. 1 is a schematic plan view of the interior side of a blank for being erected into a carton, in accordance with a first exemplary embodiment of this disclosure.

Referring now in greater detail to the drawings, FIG. 1 illustrates a multi-layer carton blank 10 having a patch 12 mounted to a blank 14 of sheet material. The patch 12 is shown in FIG. 1 as being transparent, which allows a central part of the patch to be part of a viewing window, as will be discussed in greater detail below. Since the patch 12 is transparent in FIG. 1, the blank 14 is seen through the patch.

The blank 12 has a compound hinge assembly 16 connected between tray and lid assemblies 18, 20. The hinge assembly 16 includes a laterally extending side panel that may be referred to as a perforated side panel 22 since it may at least partially contain a round hole 24 in the blank. The hole 24 divides the perforated side panel 22 into two parts, although the hole may be configured and/or positioned differently. The hole 24 may be part of the viewing window, as will be discussed in greater detail below. The perforated side panel 22 has opposite tapered ends that may be referred to as tabs 26.

The hinge assembly 16 further includes laterally extending hinge lines 28, 30 (e.g., fold lines) at opposite edges of the perforated side panel 22. Each of the hinge lines 28, 30 is interrupted by the hole 24, although the hole may be configured and/or positioned differently, as indicated above. The hinge lines 28, 30 of the hinge assembly 16 may be referred to as a tray hinge line 28 and a lid hinge line 30, since these hinge lines foldably connect the hinge assembly to the tray and lid assemblies 18, 20, respectively. The hinge assembly 16, like other features of this disclosure, may be configured and/or positioned differently. For example, the tray and lid assemblies 18, 20 may be hingedly connected to one another by a single hinge line (e.g., fold line) which may, or may not, be interrupted by the hole 24, or the like.

The tray assembly 18 has a central tray panel 32 foldably connected to the perforated side panel 22 by the tray hinge line 28. The tray assembly 18 further includes tray side panels 34, 36, 38 respectively foldably connect to peripheral edges of the central tray panel 32 by fold lines 40, 42, 44. The oblique tray side panels 36 connected by the oblique fold lines 42 have tapered flaps 46 connected to their apposite ends by fold lines 48. The flaps 46 are respectively separated from the other tray side panels 34, 38 by cuts that are more specifically in the form of slits 50. Optional annular tear lines 52, or the like, may be formed in the opposite tray side panels 34, wherein the portions of the tray side panels 34 that are at least partially circumscribed by the tear lines 52 may be manually struck (e.g., at least partially struck) from the carton erected from the blank 10. Alternatively, reference numeral 52 may designate holes, cut-outs, or the like.

The lid assembly 20 has a central lid panel 54 foldably connected to the perforated side panel 22 by the lid hinge line 30. The lid assembly 20 further includes lid side panels 56, 58, 60 respectively foldably connect to peripheral edges of the central lid panel 54 by fold lines 62, 64, 66. The oblique lid side panels 58 connected by the oblique fold lines 64 have tapered flaps 68 connected to their apposite ends by fold lines 70. The flaps 68 are respectively separated from the other lid side panels 56, 60 by cuts that may more specifically be in the form of slits 72. For each of the opposite lid side panels 56, a corner thereof may be truncated or chamfered, such that these panels each have an oblique edge 74 that transitions to a 76 convex edge.

As shown in FIG. 1, the circular hole 24 extends concentrically through the blank 14, such that the hole extends through each of the hinge, tray and lid assemblies 16, 18, 20. More specifically, the hole 24 extends through each of the hinge lines 28, 30, and through each of the panels 22, 32, 54, although the hole may be configured and/or positioned differently. As alluded to above, the hole 24 may be characterized as being a portion of a window, wherein the window further includes at least the portion of the patch 12 that is superposed with the hole 24, so that the patch obstructs (e.g., covers) the hole. Contents within the carton erected from the blank 10 may be viewed through the window.

The patch 12 may be fixedly mounted to each of the hinge, tray and lid assemblies 16, 18, 20 through the use of adhesive material and/or other suitable fastening mechanisms. Even more specifically, the patch 12 is fixedly mounted to each of the panels 22, 32, 54, and the patch extends across each of the hinge lines 28, 30. For example, the patch 12 may be fixedly mounted to the blank 14 with adhesive material that substantially circumscribes the hole 24, so that the patch completely covers the hole 24, and the patch and the adhesive material cooperatively hermetically seal closed (e.g., substantially hermetically seal closed) the hole. In the first embodiment, the patch 12 comprises, consists essentially of, or consists of one or more polymeric films (e.g., polymer film(s)) that are preferably (optionally) transparent (e.g., substantially transparent), or may be translucent. Like other features of the blank 10, the patch 12, hole 24 and/or window may be configured and/or positioned in any other suitable manner, and they may optionally be omitted.

The above-discussed first embodiment and a below-discussed second embodiment of this disclosure are alike, except for variations noted and variations that will be apparent to one of ordinary skill in the art. The second embodiment is shown in FIGS. 2-6. Due to the similarity between the first and second embodiments, the same reference numerals are used for the first and second embodiments.

Figure 2:
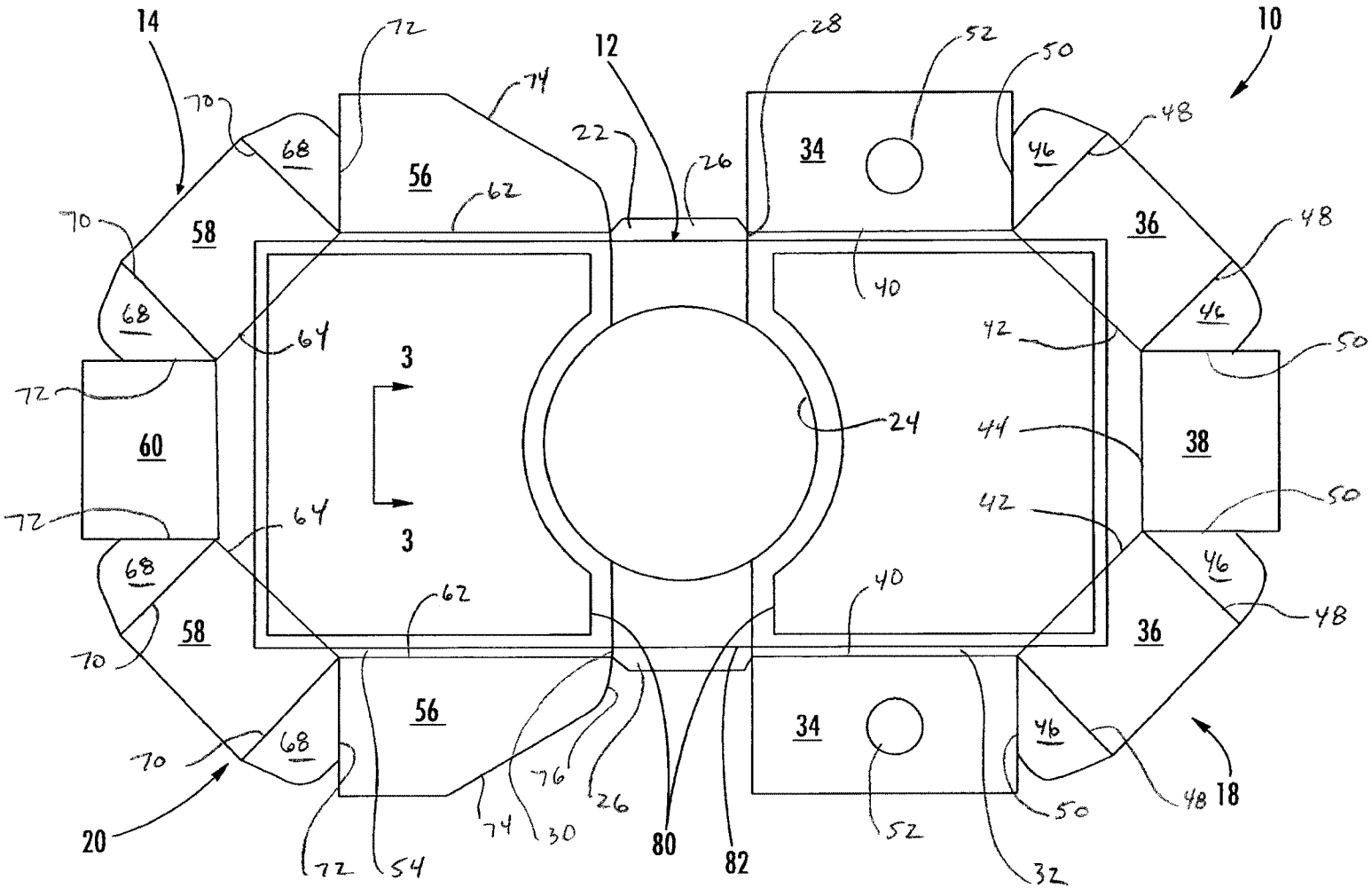
FIG. 2 is a schematic plan view of the interior side of a blank for being erected into a carton, in accordance with a second exemplary embodiment of this disclosure.

Referring to FIG. 2 and in accordance with the second embodiment, the patch 12 extends to and is mounted to each of the oblique side panels 36, 58. More generally and alternatively, the patch 12 may extend to and be mounted to one or more of, or each of, the side panels 34, 36, 38, 56, 58, 60, or the patch may be recessed from each of the side panels.

Figure 3:
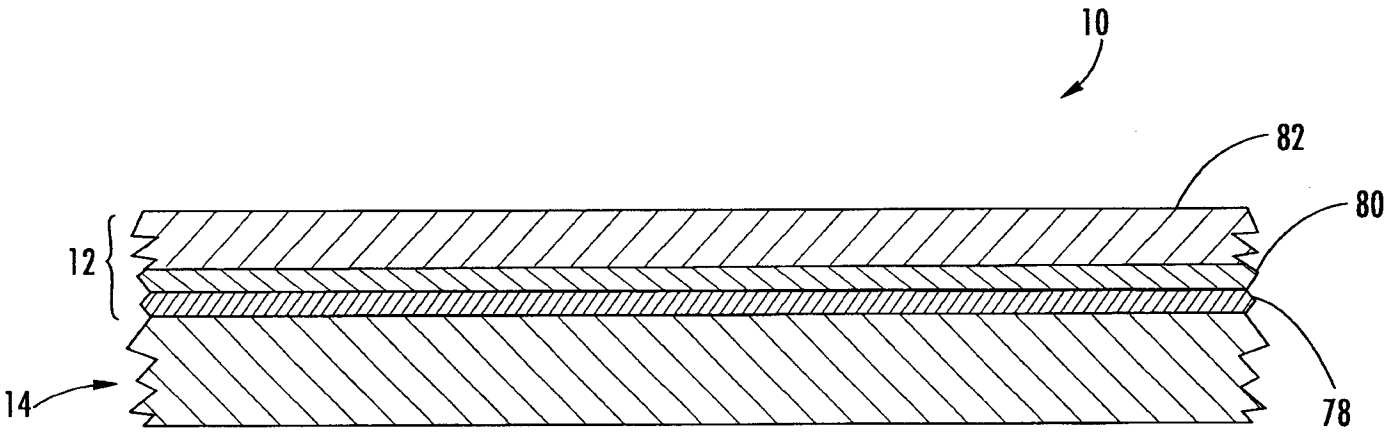
FIG. 3 is a schematic cross-sectional view of a portion of the blank of FIG. 2, wherein the cross section is taken along line 3-3 of FIG. 2.

Referring also to FIG. 3, the patch 12 of the second embodiment is fixedly mounted to the blank 14 with adhesive material 78 (e.g., glue) and/or other suitable fastening mechanisms, and the patch includes microwave energy interactive material 80 ("MEIM") which is mounted to the at least one polymeric film 82 of the patch. That is, and as will be discussed in greater detail below, the MEIM 80 may be mounted to the at least one polymeric film 82 of the patch 12, and the patch may be laminated or otherwise mounted to the blank 14, such as through the use of the adhesive material 78 and/or other suitable features. In the second embodiment and as shown in FIG. 2, the MEIM 80 is segregated into two portions that are not superposed with the hole 24, so that the MEIM does not interfere with the view through the window. Like other features of the blank 10, the patch 12, hole 24, window, adhesive 78, MEIM 80 and/or film(s) 82 may be configured and/or positioned in any other suitable manner.

Figure 4:
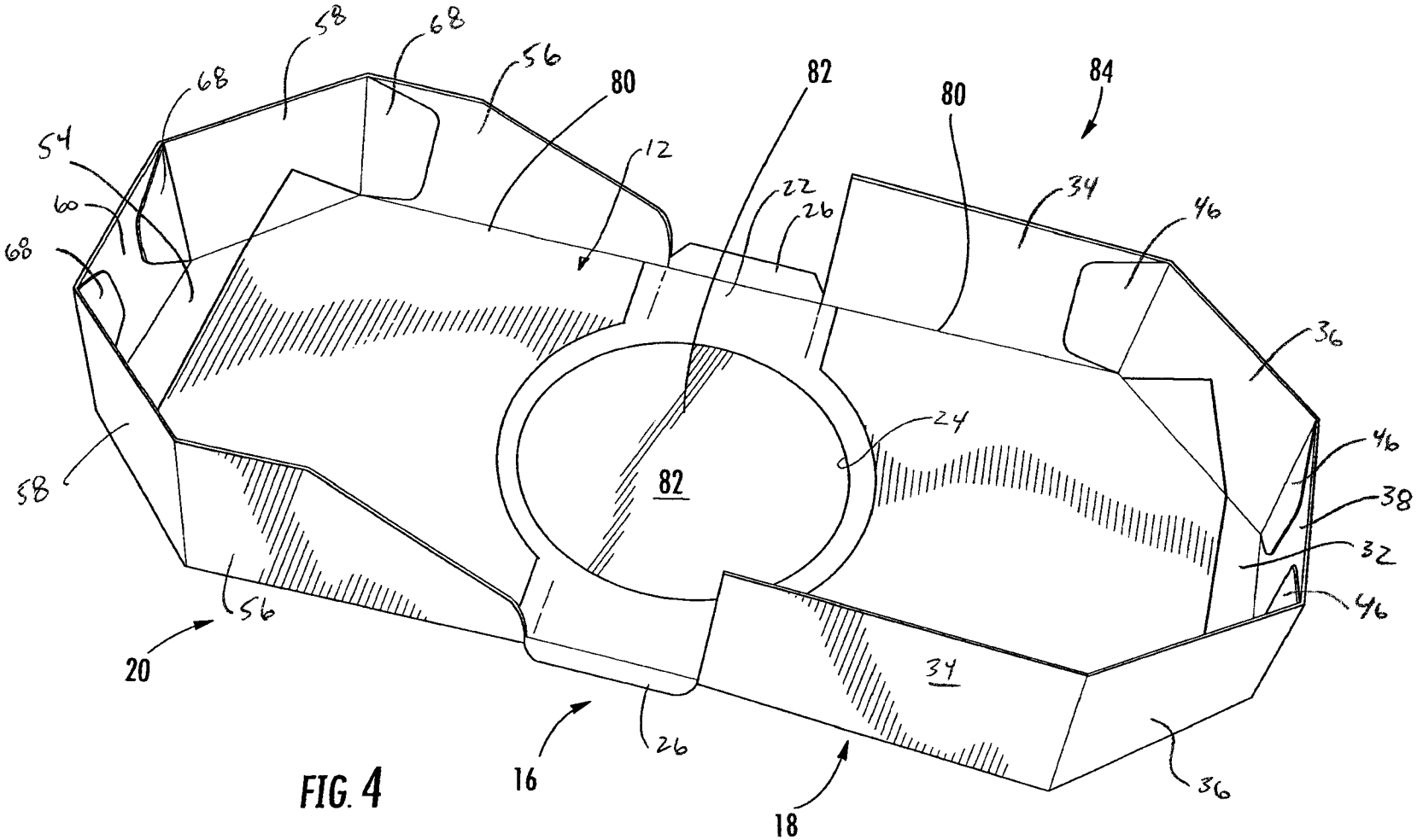
FIG. 4 is a pictorial view of a carton erected from the blank of FIG. 2, wherein the carton is in an open configuration.
Figure 5:
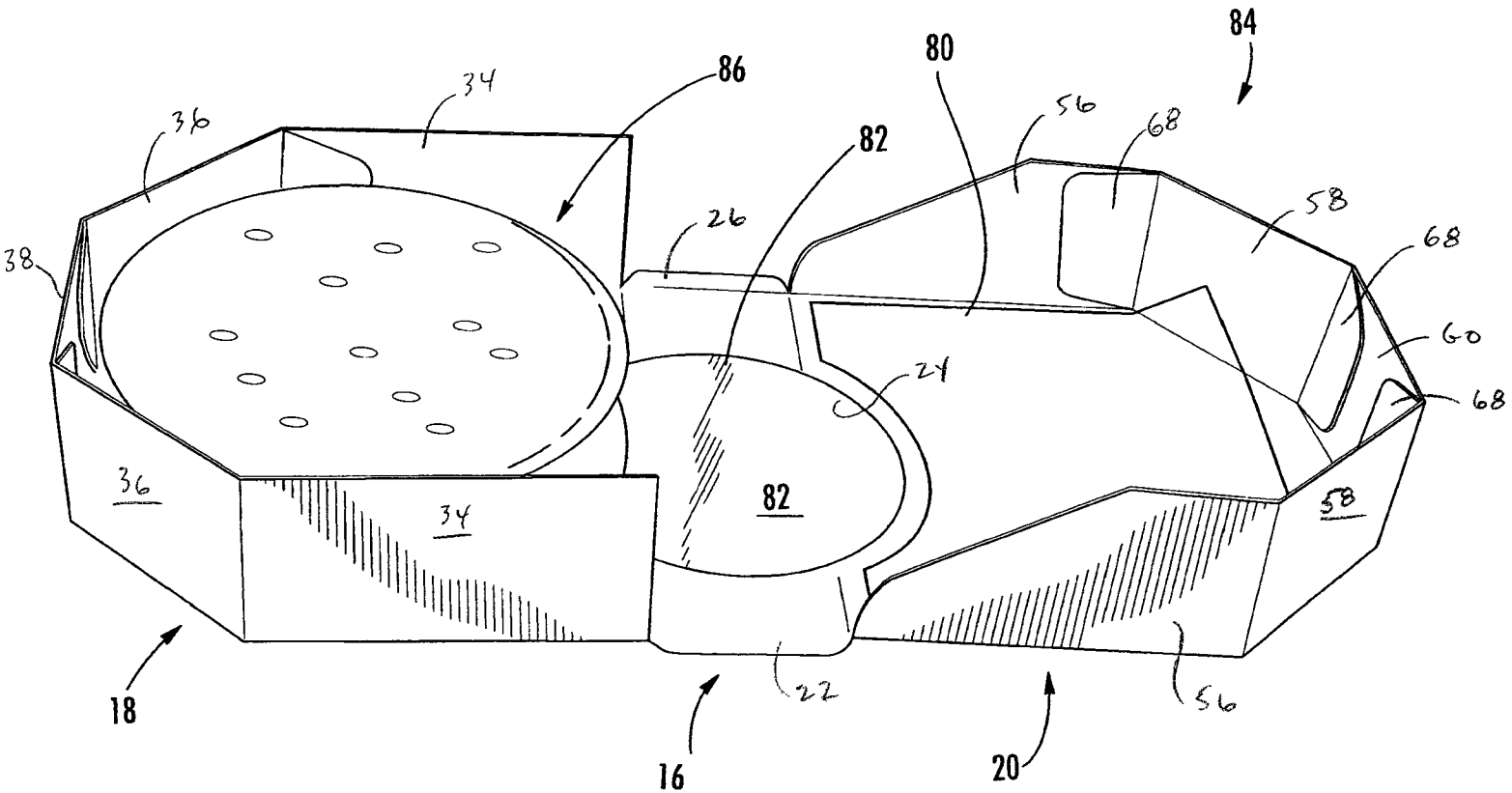
FIG. 5 is a pictorial view of the open carton of FIG. 4 at least partially containing food.
Figure 6:
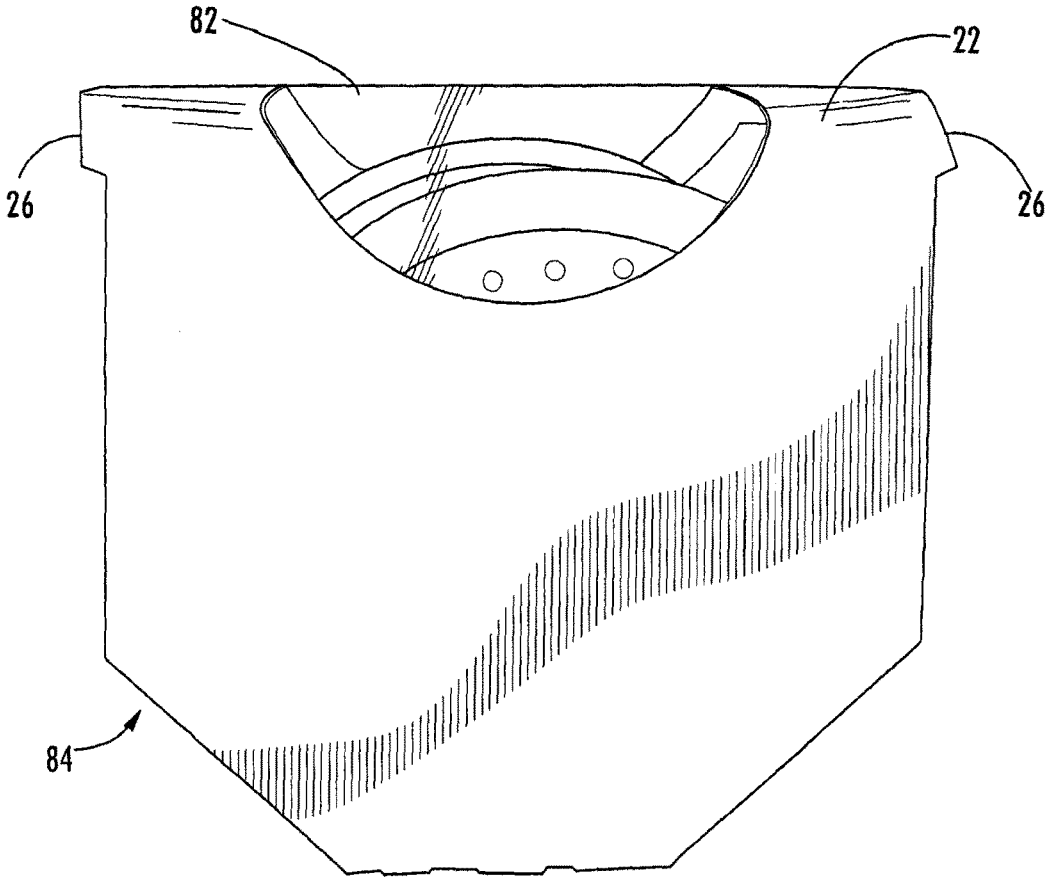
FIG. 6 is a pictorial view of the food of FIG. 5 enclosed in the carton of FIG. 5.

Referring also to FIG. 4, the blank 10 may be erected into a carton 84 by folding the side panels 34, 36, 38, 56, 58, 60 inwardly, and fixedly connecting each of the flaps 46, 68 to the adjacent side panel. For example, the flaps 46 may be fixedly mounted to their adjacent side panels 34, 38, 56, 60 with adhesive material and/or other suitable fastening mechanisms. Referring to FIGS. 5 and 6, food 86 may be placed upon the tray 18 of the carton 84, and the carton may be closed by pivoting (e.g., folding) along the hinge lines 28, 30.

The carton 84 with the food 86 closed therein may be exposed to microwave energy in a microwave oven so that the MEIM 80 influences the effect of the microwave energy on the food within the container. The MEIM 80 may comprise one or more of a susceptor, shield, and/or resonating patch antenna, as will be discussed in greater detail below. More specifically and in the version of the second embodiment illustrated in FIGS. 4 and 5, the MEIM 80 is in the form of a susceptor, and even more specifically the MEIM is a silver-colored susceptor comprising x-shaped or cross-shaped "fuses" in the form of microwave energy transparent areas that limit the random flow of current and random crazing typically observed with conventional susceptor structures. The susceptor 80 is in close proximity to the top and bottom surfaces of the food 86 when the carton 84 is closed as shown in FIG. 6, so that when the closed carton is exposed to microwave energy the, the susceptor facilitates browning of the top and bottom surface of food, as will be discussed in greater detail below.

In the second embodiment, the food 86 may be in the form of a generally cylindrical biscuit, sandwich, or the like, and the carton 84 may have truncated corners at least partially formed by the formed by the oblique side panels 36, 58. Accordingly, the portion of the carton 84 located opposite the perforated side panel 22 have a generally rounded shape. The rounded shape and/or the tabs 26 may allow the carton 84 to be easily manually handled, although one or more of these features may be omitted or configured differently. The closed carton, with the food 86 therein, may be displayed as shown in FIG. 6. The food 86 may be heated while enclosed in the carton 84, such as by placing the closed carton in a microwave oven, so as to expose the MEIM 80, carton 84 and food 86 to microwave energy. Then, the carton 84 may be removed from the microwave oven and opened, and the food 86 may be served in the open carton, for example, as shown in FIG. 5. The food 86 may be shaped differently than discussed above, and the shape and size of the carton 84 may be adapted to different shapes and sizes of foods.

Further regarding the above-discussed MEIMs (e.g., MEIM 80), a susceptor is a thin layer of MEIM that tends to absorb at least a portion of impinging microwave energy and convert it to thermal energy (i.e., heat) through resistive losses in the layer of MEIM. The remainder of the microwave energy is either reflected by or transmitted through the susceptor. Typical susceptors comprise aluminum, generally less than about 500 angstroms in thickness, for example, from about 60 to about 100 angstroms in thickness, and having an optical density of from about 0.15 to about 0.35, for example, about 0.17 to about 0.28.

The MEIM may comprise an electroconductive or semiconductive material, for example, a vacuum deposited metal or metal alloy, or a metallic ink, an organic ink, an inorganic ink, a metallic paste, an organic paste, an inorganic paste, or any combination thereof Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof Alternatively, the MEIM may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses, so that the MEIM (e.g., ITO) may extend across the above-discussed window.

Alternatively still, the MEIM may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the MEIM may be carbon-based, for example, as disclosed in U.S. Pat. Nos. 4,943,456, 5,002,826, 5,118,747, and 5,410,135.

The MEIM may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

MEIMs may be combined with polymer films (e.g., film(s) 82), such as to create microwave susceptor structures that may be referred to as susceptor films. Such polymer films may be clear, translucent, or opaque, as needed for a particular application. The thickness of the film may typically be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

According to one aspect of this disclosure, the polymeric film may comprise polyethylene terephthalate. Examples of polyethylene terephthalate film that may be suitable for use as the substrate include, but are not limited to, MELINEX®, commercially available from DuPont Teijan Films (Hopewell, Va.), and SKYROL, commercially available from SKC, Inc. (Covington, Ga.). Polyethylene terephthalate films are used in commercially available susceptors, for example, the QWIK WAVE® Focus susceptor and the MICRO-RITE.® susceptor, both available from Graphic Packaging International (Marietta, Ga.).

Susceptor film may be laminated or otherwise joined to another material, such as, but not limited to, a surface of a wall of a package or other suitable structure (e.g., blank 14). In one example, the susceptor film may be laminated or otherwise joined to paper or paperboard to make a susceptor structure having a higher thermal flux output than conventional paper or paperboard based susceptor structures. The paper may have a basis weight of from about 15 to about 60 lb/ream (lb/3000 sq. ft.), for example, from about 20 to about 40 lb/ream, for example, about 25 lb/ream. The paperboard may have a basis weight of from about 60 to about 330 lb/ream, for example, from about 80 to about 140 lb/ream. The paperboard generally may have a thickness of from about 6 to about 30 mils, for example, from about 12 to about 28 mils. In one particular example, the paperboard has a thickness of about 14 mils (0.014 inches). Any suitable paperboard may be used, for example, a solid bleached sulfate board, for example, Fortress® board, commercially available from International Paper Company, Memphis, Tenn., or solid unbleached sulfate board, such as SUS® board, commercially available from Graphic Packaging International.

If desired, the susceptor base film may undergo one or more treatments to modify the surface prior to depositing the MEIM onto the polymer film. By way of example, and not limitation, the polymer film may undergo a plasma treatment to modify the roughness of the surface of the polymer film. While not wishing to be bound by theory, it is believed that such surface treatments may provide a more uniform surface for receiving the MEIM, which in turn, may increase the heat flux and maximum temperature of the resulting susceptor structure. Such treatments are discussed in U.S. Patent Application Publication No. 2010/0213192A1 and U.S. patent application Ser. No. 13/804,673, filed Mar. 14, 2013, both of which are incorporated by reference herein in its entirety.

Also, if desired, the susceptor film may be used in conjunction with other microwave energy interactive elements and/or structures. Structures including multiple susceptor layers are also contemplated. It will be appreciated that the use of the present susceptor film and/or structure with such elements and/or structures may provide enhanced results as compared with a conventional susceptor.

By way of example, the susceptor film may be used with a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid patch generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate (e.g., a resonating patch antenna), thereby enhancing the distribution effect. Examples of microwave energy distributing elements are described in U.S. Pat. Nos. 6,204,492, 6,433,322, 6,552,315, and 6,677,563, each of which is incorporated by reference in its entirety.

In still another example, the susceptor film and/or structure may be used with or may be used to form a microwave energy interactive insulating material. Examples of such materials are provided in U.S. Pat. Nos. 7,019,271, 7,351,942, and U.S. Patent Application Publication No. 2008/0078759 A1, published Apr. 3, 2008, each of which is incorporated by reference herein in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of MEIM available for heating, browning, and/or crisping the surface of the food item. Thus, the relative amounts of microwave energy interactive areas and microwave energy transparent areas must be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to heating the environment. Additionally or alternatively, it may be beneficial to create one or more discontinuities or inactive regions to prevent overheating or charring of the food item and/or the construct including the susceptor.

As still another example and as mentioned above with reference to FIGS. 4 and 5, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. Nos. 5,412,187, 5,530,231, U.S. Patent Application Publication No. 2008/0035634A1, published Feb. 14, 2008, and PCT Application Publication No. WO 2007/127371, published Nov. 8, 2007, each of which is incorporated by reference herein in its entirety.

It will be noted that any of such discontinuities or apertures in a susceptor may comprise a physical aperture or void in one or more layers or materials used to form the structure or construct, or may be a non-physical "aperture". A non-physical aperture is a microwave energy transparent area that allows microwave energy to pass through the structure without an actual void or hole cut through the structure. Such areas may be formed by simply not applying MEIM to the particular area, by removing MEIM from the particular area, or by mechanically deactivating the particular area (rendering the area electrically discontinuous). Alternatively, the areas may be formed by chemically deactivating the MEIM in the particular area, thereby transforming the MEIM in the area into a substance that is transparent to microwave energy (i.e., so that the microwave energy transparent or inactive area comprises the MEIM in an inactivated condition). While both physical and non-physical apertures allow the food item to be heated directly by the microwave energy, a physical aperture also provides a venting function to allow steam or other vapors or liquid released from the food item to be carried away from the food item.

In general, the blank 14 may be constructed from paperboard having a caliper so that it is heavier and more rigid than ordinary paper. That is, the base material of the blank may be paperboard. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a line of disruption in the form of a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

A line of disruption in the form of a fold line (e.g., hinge line) can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

In the foregoing, all values, relationships, configurations and other features may be approximate. Also, fold, hinge and tear lines may be more generally referred to as lines of disruption.

The above examples are in no way intended to limit the scope of the present disclosure. It will be understood by those skilled in the art that while the present disclosure has been discussed above with reference to exemplary embodiments, various additions, modifications and changes can be made thereto without departing from the spirit and scope of the disclosure.

What is claimed is:

1. A carton for heating a food product, the carton comprising:

a lid comprising a central lid panel and a plurality of lid side panels foldably connected to the central, lid panel, the plurality of lid side panels comprises a first lid side panel foldably connected to the central lid panel along a first fold line, a second lid side panel foldably connected to the central lid panel along a second fold line, a third lid side panel foldably connected to the central lid panel along a third fold line, a fourth lid side panel foldably connected to the central lid panel along a fourth fold line, and a fifth lid side panel foldably connected to the central lid panel along a fifth fold line, the second lid side panel is oblique relative to the first lid side panel, the third lid side panel is oblique relative to the first lid side panel, the fourth lid side panel is perpendicular relative to the first lid side panel, and the fifth lid side panel is perpendicular relative to the first lid side panel, wherein the second lid side panel extends from the first lid side panel to the fourth lid side panel, and the third lid side panel extends from the first lid side panel to the fifth lid side panel;

a tray comprising a central tray panel and a plurality of tray side panels foldably connected to the central tray panel;

a side panel foldably connected to the central tray panel and the central lid panel, wherein the fourth lid side panel extends from the second lid side panel to the side panel, and the fifth lid side panel extends from the third lid side panel to the side panel; and an aperture in at least a portion of each of the side panel, the central tray panel, and the central lid panel.

2. The carton of claim 1, wherein the aperture divides the side panel into a first section and a second section.

3. The carton of claim 2, wherein the central lid panel is foldably connected to the side panel at a sixth fold line, the central tray panel is foldably connected to the side panel at a seventh fold line, the aperture extends from the sixth fold line to the seventh fold line.

4. The carton of claim 1, further comprising a patch attached to at least one of the side panel, the central lid panel, and the central tray panel.

5. The carton of claim 4, wherein the patch is transparent and covers the aperture to form a viewing window in the carton.

6. The carton of claim 4, wherein the patch comprises a polymeric film.

7. The carton of claim 6, wherein the patch includes microwave energy interactive material mounted to at least a portion of the polymeric film.

8. The carton of claim 7, wherein the microwave energy interactive material comprises a first portion mounted to the central lid panel and a second portion mounted to the central tray panel.

9. The carton of claim 8, wherein the first portion and the second portion are spaced apart from the aperture.

10. The carton of claim 7, wherein the microwave interactive material is a susceptor.

11. The carton of claim 5, wherein the plurality of tray side panels comprises a first tray side panel foldably connected to the central tray panel along a sixth fold line, a second tray side panel foldably connected to the central tray panel along a seventh fold line, a third tray side panel foldably connected to the central tray panel along a eighth fold line, a fourth tray side panel foldably connected to the central tray panel along a ninth fold line; and a fifth tray side panel foldably connected to the central tray panel along a tenth fold line, the second tray side panel is oblique relative to the first tray side panel, the third tray side panel is oblique relative to the first tray side panel, the fourth tray side panel is perpendicular relative to the first tray side panel, and the fifth tray side panel is perpendicular relative to the first tray side panel.

12. The carton of claim 11, wherein the first lid side panel and the first tray side panel cooperate to form an end wall of the carton, the second lid side panel and the second tray side panel cooperate to form a first sidewall of the carton, and the third lid side panel and the third tray side panel cooperate to form a second sidewall of the carton, the first sidewall and the second sidewall are angled with respect to the end wall.

13. The carton of claim 12, wherein the end wall is a first end wall and the carton further comprises a second end wall opposite the first end wall, the second end wall comprises the side panel and at least a portion of the viewing window.

14. The carton of claim 13, wherein the fourth lid side panel and the fourth tray side panel cooperate to form a third sidewall extending from the first sidewall to the second end wall and the fifth lid side panel and the fifth tray side panel cooperate to form a fourth sidewall extending from the second sidewall to the second end wall.

15. The carton of claim 11, wherein the patch is in contact with at least one of the second lid side panel and the third lid side panel.

16. The carton of claim 15, wherein the patch is in contact with at least one of the second tray side panel and the third tray side panel.

17. A blank for forming a carton for heating a food product, the blank comprising:

a lid portion for forming a lid in the carton formed from the blank, the lid portion comprising a central lid panel and a plurality of lid side panels foldably connected to the central lid panel, the plurality of lid side panels comprises a first lid side panel foldably connected to the central lid panel along a first fold line, a second lid side panel foldably connected to the central lid panel along a second fold line, a third lid side panel foldably connected to the central lid panel along a third fold line, a fourth lid side panel foldably connected to the central lid panel along a fourth fold line, and a fifth lid side panel foldably connected to the central lid panel along a fifth fold line, the second lid side panel is oblique relative to the first lid side panel, the third lid side panel is oblique relative to the first lid side panel, the fourth lid side panel is perpendicular relative to the first lid side panel, and the fifth lid side panel is perpendicular relative to the first lid side panel, wherein the second lid side panel extends from the first lid side panel to the fourth lid side panel, and the third lid side panel extends from the first lid side panel to the fifth lid side panel;

a tray portion for forming a tray in the carton formed from the blank, the tray portion comprising a central tray panel and a plurality of tray side panels foldably connected to the central tray panel;

a side panel foldably connected to the central tray panel and the central lid panel, wherein the fourth lid side panel extends from the second lid side panel to the side panel, and the fifth lid side panel extends from the third lid side panel to the side panel; and an aperture in at least a portion of each of the side panel, the central tray panel, and the central lid panel.

18. The blank of claim 17, wherein the aperture divides the side panel into a first section and a second section.

19. The blank of claim 18, wherein the central lid panel is foldably connected to the side panel at a sixth fold line, the central tray panel is foldably connected to the side panel at a seventh fold line, the aperture extends from the sixth fold line to the seventh fold line.

20. The blank of claim 17, further comprising a patch attached to at least one of the side panel, the central lid panel, and the central tray panel.

21. The blank of claim 20, wherein the patch is transparent and covers the aperture for forming a viewing window in the carton formed from the blank.

22. The blank of claim 20, wherein the patch comprises a polymeric film.

23. The blank of claim 22, wherein the patch includes microwave energy interactive material mounted to at least a portion of the polymeric film.

24. The blank of claim 23, wherein the microwave energy interactive material comprises a first portion mounted to the central lid panel and a second portion mounted to the central tray panel.

25. The blank of claim 24, wherein the first portion and the second portion are spaced apart from the aperture.

26. The blank of claim 23, wherein the microwave interactive material is a susceptor.

27. The blank of claim 21, wherein the plurality of tray side panels comprises a first tray side panel foldably connected to the central tray panel along a sixth fold line, a second tray side panel foldably connected to the central tray panel along a seventh fold line, a third tray side panel foldably connected to the central tray panel along a eighth fold line, a fourth tray side panel foldably connected to the central tray panel along a ninth fold line; and a fifth tray side panel foldably connected to the central tray panel along a tenth fold line, the second tray side panel is oblique relative to the first tray side panel, the third tray side panel is oblique relative to the first tray side panel, the fourth tray side panel is perpendicular relative to the first tray side panel, and the fifth tray side panel is perpendicular relative to the first tray side panel.

28. The blank of claim 27, wherein the first lid side panel and the first tray side panel are for forming an end wall of the carton formed from the blank, the second lid side panel and the second tray side panel are for forming a first sidewall of the carton, the third lid side panel and the third tray side panel are for forming a second sidewall of the carton, the fourth lid side panel and the fourth tray side panel are for forming a third sidewall of the carton, and the fifth lid side panel and the fifth tray side panel are for forming a fourth sidewall of the carton, the first sidewall and the second sidewall are angled with respect to the end wall in the carton formed from the blank.

29. The blank of claim 27, wherein the patch is in contact with at least one of the second lid side panel and the third lid side panel.

30. The blank of claim 29, wherein the patch is in contact with at least one of the second tray side panel and the third tray side panel.

31. A method of forming a carton, the method comprising;

obtaining a blank comprising a lid portion having a central lid panel and a plurality of lid side panels foldably connected to the central lid panel, a tray portion having a central tray panel and a plurality of tray side panels foldably connected to the central tray panel, a side panel foldably connected to the central tray panel and the central lid panel, and an aperture in at least a portion of each of the side panel, the central tray panel, and the central lid panel, the plurality of lid side panels comprises a first lid side panel foldably connected to the central lid panel along a first fold line, a second lid side panel foldably connected to the central lid panel along a second fold line, a third lid side panel foldably connected to the central lid panel along a third fold line, a fourth lid side panel foldably connected to the central lid panel along a fourth fold line, and a fifth lid side panel foldably connected to the central lid panel along a fifth fold line, the second lid side panel is oblique relative to the first lid side panel, the third lid side panel is oblique relative to the first lid side panel, the fourth lid side panel is perpendicular to the first lid side panel, and the fifth lid side panel is perpendicular to the first lid side panel;

forming a lid of the carton by positioning the plurality of lid side panels relative to the central lid panel, wherein the second lid side panel extends from the first lid side panel to the fourth lid side panel, the fourth lid side panel extends from the second lid side panel to the side panel, the third lid side panel extends from the first lid side panel to the fifth lid side panel, and the fifth lid side panel extends from the third lid side panel to the side panel; and forming a tray of the carton by positioning the plurality of tray side panels relative to the central tray panel, the tray being foldably connected to the lid by way of the side panel.

32. The method of claim 31, wherein the aperture divides the side panel into a first section and a second section.

33. The method of claim 32, wherein the central lid panel is foldably connected to the side panel at a sixth fold line, the central tray panel is foldably connected to the side panel at a seventh fold line, the aperture extends from the sixth fold line to the seventh fold line.

34. The method of claim 31, wherein the blank comprises a patch attached to at least one of the side panel, the central lid panel, and the central tray panel, the patch is transparent and covers the aperture to form a viewing window in the carton formed from the blank.

35. The method of claim 34, wherein the patch comprises a polymeric film and includes microwave energy interactive material mounted to at least a portion of the polymeric film.

36. The method of claim 35, wherein the microwave energy interactive material comprises a first portion mounted to the central lid panel and a second portion mounted to the central tray panel.

37. The method of claim 35, wherein the microwave interactive material is a susceptor.

38. The method of claim 31, further comprising placing a food product in the tray and folding the lid relative to the tray to close the carton.

39. The method of claim 38, further comprising heating the carton in a microwave oven.

40. The method of claim 38, wherein the plurality of tray side panels comprises a first tray side panel foldably connected to the central tray panel along a sixth fold line, a second tray side panel foldably connected to the central tray panel along a seventh fold line, a third tray side panel foldably connected to the central tray panel along a eighth fold line, a fourth tray side panel foldably connected to the central tray panel along a ninth fold line; and a fifth tray side panel foldably connected to the central tray panel along a tenth fold line, the second tray side panel is oblique relative to the first tray side panel, the third tray side panel is oblique relative to the first tray side panel, the fourth tray side panel is perpendicular relative to the first tray side panel, and the fifth tray side panel is perpendicular relative to the first tray side panel.

41. The method of claim 40, the closing the carton comprises forming an end wall by positioning the first lid side panel and the first tray side panel in face-to-face contact, forming a first sidewall by positioning the second lid side panel and the second tray side panel in face-to-face contact, forming a second sidewall by positioning the third lid side panel and the third tray side panel in face-to-face contact, forming a third sidewall by positioning the fourth lid side panel and the fourth tray side panel in face-to-face contact, and forming a fourth sidewall by positioning the fifth lid side panel and the fifth tray side panel in face-to-face contact, wherein the first sidewall and the second sidewall are angled with respect to the end wall in the carton formed from the blank.

42. The method of claim 41, wherein the end wall is a first end wall and the carton further comprises a second end wall opposite the first end wall, the second end wall comprises the side panel and at least a portion of the viewing window, a third sidewall extending from the first sidewall to the second end wall and a fourth sidewall extending from the second sidewall to the second end wall.

43. The carton of claim 1, wherein the lid further comprises a first flap and a second flap each foldably connected to the second lid side panel along a respective sixth fold line and seventh fold line and a third flap and a fourth flap each foldably connected to the third lid side panel along a respective eighth fold line and ninth fold line, each of the first flap and the third flap is attached in face-to-face contact with the first lid side panel, the second flap is attached in face-to-face contact with the fourth lid side panel, and the fourth flap is attached in face-to-face contact with the fifth lid side panel.

44. The blank of claim 17, wherein the lid further comprises a first flap and a second flap each foldably connected to the second lid side panel along a respective sixth fold line and seventh fold line and a third flap and a fourth flap each foldably connected to the third lid side panel along a respective eighth fold line and ninth fold line, each of the first flap and the third flap is for being attached in face-to-face contact with the first lid side panel when the carton is formed from the blank, the second flap is for being attached in face-to-face contact with the fourth lid side panel when the carton is formed from the blank, and the fourth flap is for being attached in face-to-face contact with the fifth lid side panel when the carton is formed from the blank.

45. The method of claim 31, wherein the lid further comprises a first flap and a second flap each foldably connected to the second lid side panel along a respective sixth fold line and seventh fold line and a third flap and a fourth flap each foldably connected to the third lid side panel along a respective eighth fold line and ninth fold line, and the forming the lid of the carton further comprises attaching each of the first flap and the third flap in face-to-face contact with the first lid side panel, attaching the second flap in face-to-face contact with the fourth lid side panel, and attaching the fourth flap in face-to-face contact with the fifth lid side panel.

* * * * *